US008823287B2

(12) United States Patent
Munari et al.

(10) Patent No.: US 8,823,287 B2
(45) **Date of Patent: *Sep. 2, 2014**

(54) SYSTEM AND METHOD FOR NON-LINEAR DIMMING OF A LIGHT SOURCE

(71) Applicant: Infineon Technologies Austria AG, Villach (AT)

(72) Inventors: Diego Gaetano Munari, Padua (IT); Andrea Scenini, Montegrotto Terme (IT); Roberto Filippo, Beinasco (IT); Andrea Logiudice, Padua (IT); Federico Tosato, Pernumia (IT)

(73) Assignee: Infineon Technologies Austria AG, Villach (AT)

( * ) Notice: Subject to any disclaimer, the term of this patent is extended or adjusted under 35 U.S.C. 154(b) by 0 days.

This patent is subject to a terminal disclaimer.

(21) Appl. No.: 13/661,928

(22) Filed: Oct. 26, 2012

(65) Prior Publication Data

US 2013/0049584 A1 Feb. 28, 2013

Related U.S. Application Data

(63) Continuation of application No. 12/564,362, filed on Sep. 22, 2009, now Pat. No. 8,299,729.

(51) Int. Cl.
*H05B 41/36* (2006.01)

(52) U.S. Cl.
USPC ..... 315/307; 315/291; 315/DIG. 4

(58) Field of Classification Search
USPC ..... 315/DIG. 4, 224, 291, 294, 297, 299, 315/312
See application file for complete search history.

(56) References Cited

U.S. PATENT DOCUMENTS

| | | | | |
|---|---|---|---|---|
| 5,122,799 | A | 6/1992 | Ledzius et al. | |
| 5,754,013 | A * | 5/1998 | Praiswater | 315/307 |
| 2006/0175990 | A1 | 8/2006 | Adler et al. | |
| 2011/0007199 | A1 | 1/2011 | Heim et al. | |

FOREIGN PATENT DOCUMENTS

| | | | |
|---|---|---|---|
| WO | 2008070977 | A1 | 6/2008 |
| WO | WO 2009/103751 | | 8/2009 |

OTHER PUBLICATIONS

Tosato, F., "Design and Implementation of a Pulse Density Control for Red/Green/Blue LED," Dec. 18, 2008, pp. 116.

* cited by examiner

*Primary Examiner* — Douglas W Owens
*Assistant Examiner* — Jianzi Chen
(74) *Attorney, Agent, or Firm* — Slater & Matsil, L.L.P.

(57) ABSTRACT

In one embodiment, a light dimming module is disclosed. The light dimming module has a dimming engine coupled to a digital input interface and an output interface. The dimming engine is configured to provide a N-segment piecewise linear exponential digital control signal, and the output interface is configured to control the intensity of a light source.

24 Claims, 14 Drawing Sheets

| SEGMENT | | LEVEL | THRESHOLD 2n-1 | | SLOPE PARAMETER | $SLOPE^{-1}$ |
|---|---|---|---|---|---|---|
| | | 0 | 0 | | | |
| 0 | | | | | 255 | 256 |
| | | 1 | 1 | | | |
| 1 | | | | | 255 | 256 |
| | | 2 | 3 | | | |
| 2 | | | | | 255 | 256 |
| | | 3 | 7 | | | |
| 3 | | | | | 255 | 256 |
| | | 4 | 15 | | | |
| 4 | | | | | 255 | 256 |
| | | 5 | 31 | | | |
| 5 | | | | | 127 | 128 |
| | | 6 | 63 | | | |
| 6 | | | | | 63 | 64 |
| | | 7 | 127 | | | |
| 7 | | | | | 31 | 32 |
| | | 8 | 255 | | | |
| 8 | | | | | 15 | 16 |
| | | 9 | 511 | | | |
| 9 | | | | | 7 | 8 |
| | | 10 | 1023 | | | |
| 10 | | | | | 3 | 4 |
| | | 11 | 2047 | | | |
| 11 | | | | | 1 | 2 |
| | | 12 | 4095 | | | |

*FIG. 8b*

SYSTEM AND METHOD FOR NON-LINEAR DIMMING OF A LIGHT SOURCE

This application is a continuation of U.S. patent application Ser. No. 12/564,362, entitled "System and Method for Non-Linear Dimming of a Light Source," filed on Sep. 22, 2009, which application is incorporated herein by reference.

CROSS REFERENCE TO RELATED APPLICATIONS

This application relates to the following co-pending and commonly assigned EPO patent application: Application number EP09155019.4, filed Mar. 12, 2009, entitled "Sigma Delta Current Source and LED Driver," which application is hereby incorporated herein by reference.

TECHNICAL FIELD

This invention relates generally to semiconductor circuits, and more particularly to a system and method for non-linear dimming of a light source.

BACKGROUND

In places that require variable illumination, such as homes, theaters, auditoriums, and the interiors of automobiles, it is desirable to gradually change the level of illumination in order for the human eye to comfortably adapt to changes in light intensity. Such a change in illumination is achievable via electronic and computer control, from computer controlled interior lighting systems to simple light dimmer circuits.

As the requirements for lighting systems have become more sophisticated, however, the circuitry required to support time variable lighting control has required high system and circuit complexity, precise analog components, and high resource demands both in terms of circuit board area and the number of required electronic components. The interior of an automobile, for example, may require at least a dozen lights, each of which are independently controllable. While a microcontroller can be used to generate independent pulse modulated signals to vary the intensity of each light, the disadvantage of such an approach is that microcontrollers typically have a limited number of available hardware resources such as timers, interrupt lines, and general purpose I/O pins. The use of software and CPU resources to track and control dimming profiles of multiple lights leaves fewer resources available to other automotive applications such as power train and safety systems.

In the field of illumination systems, what are needed are cost effective systems for the control of light intensity.

SUMMARY OF THE INVENTION

In one embodiment, a light dimming module is disclosed. The light dimming module has a dimming engine coupled to a digital input interface and an output interface. The dimming engine is configured to provide a N-segment piecewise linear exponential digital control signal, and the output interface is configured to control the intensity of a light source.

The foregoing has outlined, rather broadly, features of the present invention. Additional features of the invention will be described, hereinafter, which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 8*b* illustrates a threshold diagram of an embodiment dimming engine;

Corresponding numerals and symbols in different figures generally refer to corresponding parts unless otherwise indicated. The figures are drawn to clearly illustrate the relevant aspects of embodiments of the present invention and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of embodiments are discussed in detail below. It should be appreciated, however, that the present invention provides many applicable inventive concepts that may be embodied in a wide variety of specific contexts. The specific embodiments discussed are merely illustrative of specific ways to make and use the invention, and do not limit the scope of the invention.

The present invention will be described with respect to embodiments in a specific context, namely a light-dimming engine. Embodiments of this invention may also be applied to other circuits and systems that require non-linear control of time varying signals.

Figure 1:
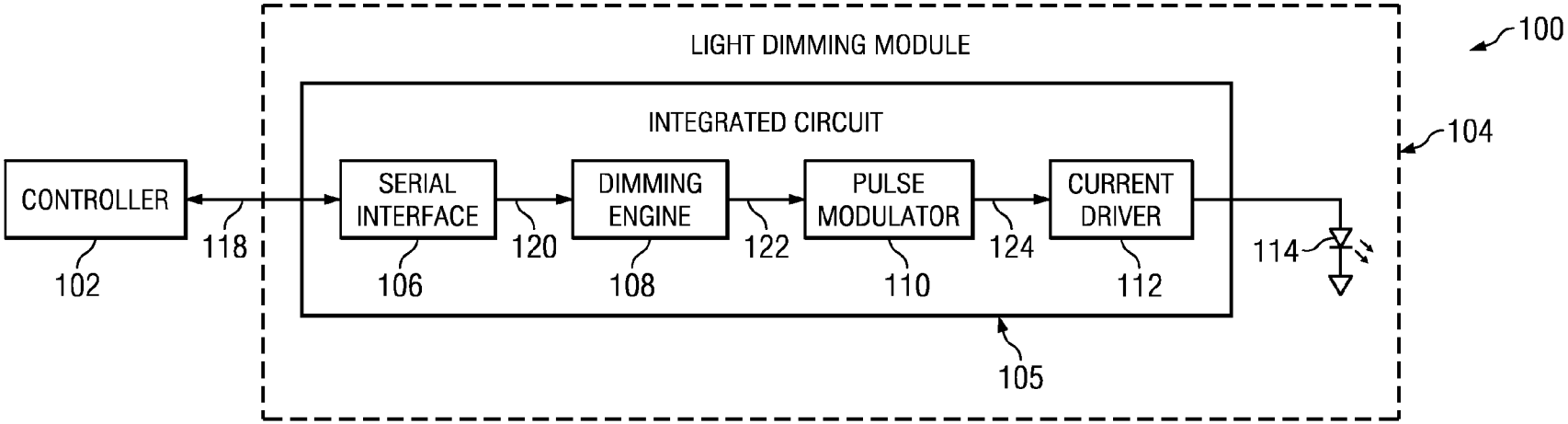
FIG. 1 illustrates an embodiment automotive light control system.

An automotive light control system 100 according to an embodiment of the present invention is illustrated in FIG. 1. Controller 102 is coupled to light dimming module 104 that controls the illumination level of light emitting diode (LED) 114. Light dimming module 104 has serial interface 106, dimming engine 108, pulse modulator 110 and current driver 112. In embodiments of the present invention, serial interface 106, dimming engine 108, pulse modulator 110 and current driver 112 are fabricated on integrated circuit 105. Light dimming module, implemented on a printed circuit board (PCB) has integrated circuit 105 and LED 114. In alternative embodiments of the present invention, various functional blocks of light dimming module 104 can be partitioned differently. Other types of circuit carriers besides PCBs can be used.

Controller 102 is implemented as a microcontroller and serial interface 106 is implemented as a local interconnect network (LIN) in an embodiment of the present invention. In automotive applications, a single controller 102 can address multiple light dimming modules 104 via bus 118. In alternative embodiments of the present invention, other bus types can be used besides a LIN bus, for example, a controller area network (CAN) bus, a SPI bus, I2C bus, UART bus, and many others.

To change the illumination intensity of LED 114, a digital command is transmitted from controller 102 to digital interface 106. In an embodiment, the digital control word contains a starting intensity level D0, a final intensity level D1 and a transition time factor N. In other embodiments, the digital control word can contain other command words representative of illumination intensities and illumination transition times. Dimming engine 108 receives a command from serial interface 106 via bus 120 and generates a time varying digital signal 122 representative of a controlled illumination level that smoothly transitions from starting intensity level D0 to final intensity level D1 over a predetermined transition time controlled by transition time factor N. The transition from D0 to D1 can be a linear transition or a non-linear transition. In other embodiments, other digital formats can be used, for example, a format that provides a command for a dim up transition time, a dim down transition time, and a desired final illumination level, in which case the starting illumination level is derived from a final state of the dimming engine, or is zero if the dimming engine was started from a reset state.

In an embodiment of the present invention, pulse modulator 110 is implemented by a sigma-delta modulator that generates a pulse train of a particular density at output 124 of pulse modulator 110. In alternative embodiments, other architectures for pulse modulator 110 can be used, for example, a pulse width modulator (PWM), or other forms of pulse density modulators (PDM). Current driver 112 converts the pulse train at output 124 to an appropriate drive current for LED 114. In alternative embodiments of the present invention, pulse modulator 110 can be implemented with other circuits such as counters, decimators, and other circuits that use other pulse modulation methods besides sigma-delta modulation. In further embodiments of the present invention, digital output 112 of dimming engine 108 can be converted to the analog domain and used to directly drive a light source. Furthermore, in alternative embodiments of the present invention, other illumination sources besides a LED can be used, for example, an incandescent light bulb. In the case of alternative light sources, an appropriate driving circuit can replace current driver 112.

Figure 2:
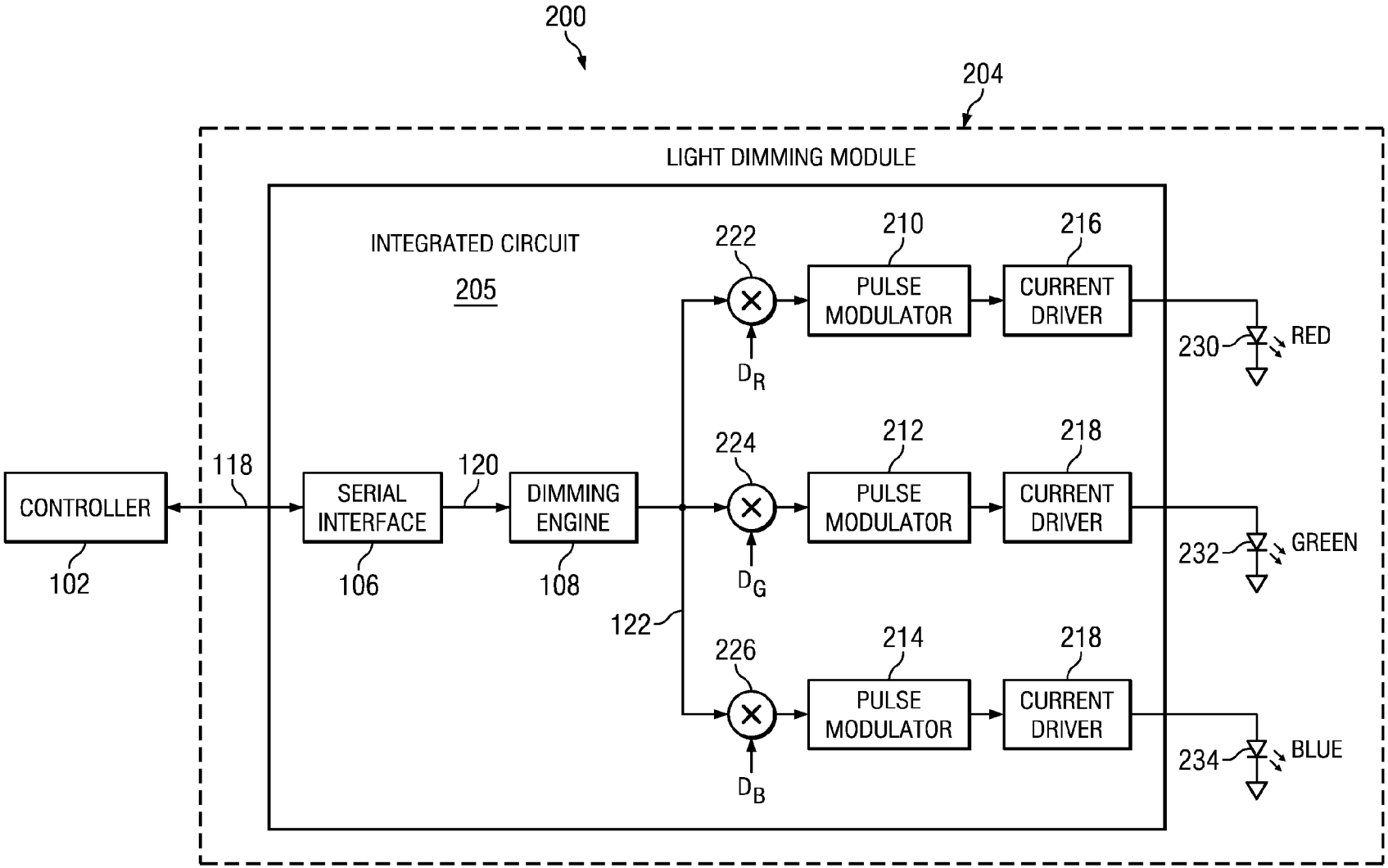
FIG. 2 illustrates another embodiment automotive light control system.

FIG. 2 illustrates another embodiment of the present invention that utilizes red LED 230, green LED 232 and blue LED 234 to implement a light source with a programmable color. Serial interface 106 receives illumination commands from controller 102 and dimming engine 108 provides a time varying illumination control signal 122. Red LED 230 has its own independent pulse modulator 210 and current driver 216, green LED 232 has its own independent pulse modulator 212 and current driver 218, and blue LED 234 has its own independent pulse modulator 214 and current driver 220. The composite color of LEDs 230, 232 and 234 is achieved by multiplying illumination control signal 122 by weighting factors $D_R$, $D_G$ and $D_B$. Weighting factors $D_R$, $D_G$ and $D_B$ can be programmed to produce a multitude of colors by varying their relative amplitudes. In some embodiments of the present invention, serial interface 106, dimming engine 108, multipliers 222, 224 and 226, pulse modulators 210, 212 and 214, and current drivers 216, 218 and 220 reside on integrated circuit 205. In other embodiments, light dimming module 204 may be partitioned differently.

Figure 3:
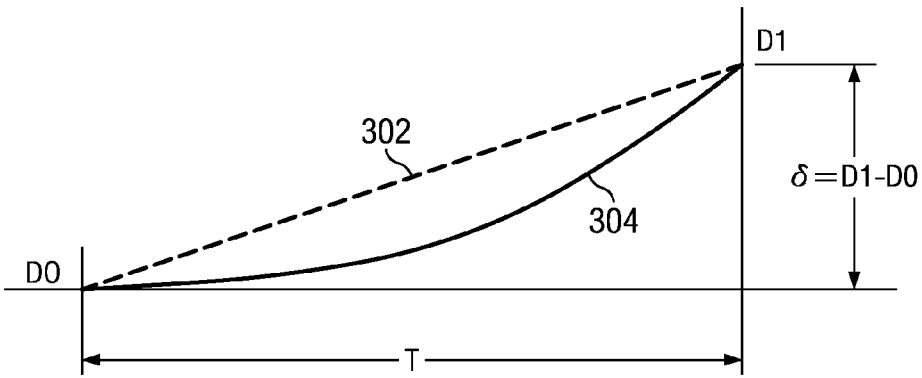
FIG. 3 illustrates a graph of an embodiment transition characteristic.

Turning to FIG. 3, a graph of transition characteristics from intensity D0 to intensity D1 is illustrated. Both curves 302 and 304 transition from D0 to D1 in time T. Curve 302, however, represents a linear transition characteristic and curve 304 represents an exponential and non-linear transition characteristic. In embodiments of the present invention, a non-linear characteristic is used to account for the physiology of how the human eye responds to changes in light intensity and/or to pursue special lighting effects. In particular, the retina of the human eye contains rods and cones. Cones are adapted to detect colors, and function well in bright light, while rods are more sensitive, but do not detect colors and are adapted for detecting low levels of light. Because rods have a higher sensitivity to low intensity light and the cones have a lower sensitivity to high levels of light, the eye is very sensitive to small changes of illumination in low lighting conditions, and less sensitive to changes in lighting conditions at higher levels of illumination. Rods also have a slower response to changes in illumination than cones. For these reasons, an exponential dimming profile, such as that of curve 304, that has a gradual slope at low levels of illumination and a higher slope at higher levels of illumination appears very natural to the eye. Furthermore, the gradual slope at low levels of illumination allows the eye to comfortably adapt to increasing and decreasing illumination. Furthermore, according to the Weber-Fechner law, the human body has a logarithmic response to stimuli such as light, sound and weight:

$$p=k\ln(S/S_0),$$

where p is a variable related to perception, S is a level of stimulus, and S0 is a threshold of stimulus below which stimulus is not perceived, and k is an experimentally derived constant.

Figure 4:
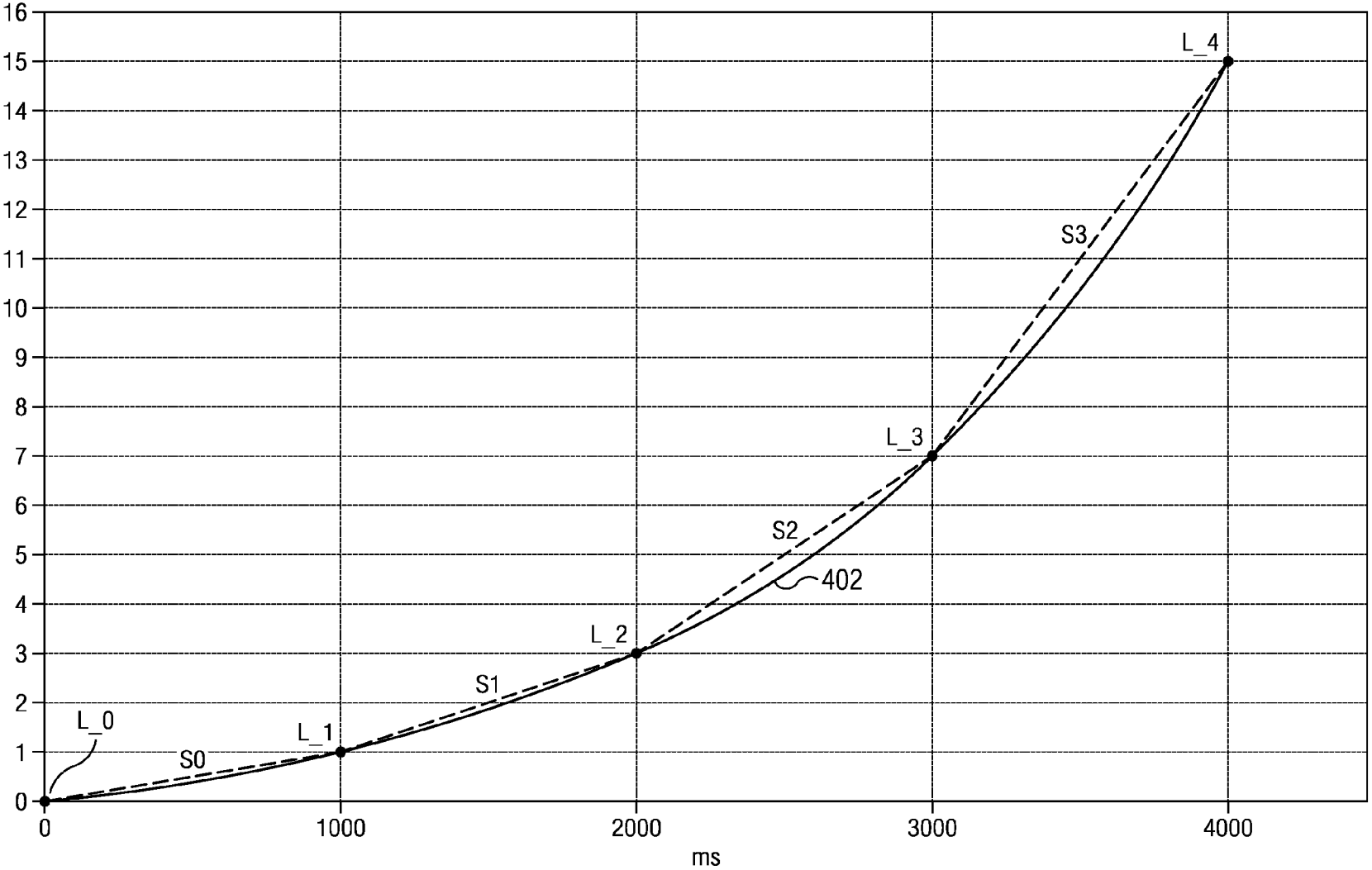
FIG. 4 illustrates an embodiment piecewise linear dimming profile.

In an embodiment of the present invention, an exponential dimming profile is approximated by a piecewise linear approximation as shown, for example, in FIG. 4. Exponential dimming curve 402 increases from a start level of zero (Start_level) at Time=0 seconds to an amplitude of 15 (Stop_level) at Time=4 seconds. Exponential dimming curve 402 is approximated by piecewise linear segments S0, S1, S2 and S3. In some embodiments, points L__0, L__1, L__2, L__3 and L__4 correspond to points that can be set as start or stop intensity levels. In alternative embodiments, other points on segments S0, S1, S2 and S3 can be set as start or stop intensity levels. In embodiments of the present invention, the time interval between Start_level and Stop_level is preferably independent of the respective levels for Start_level and Stop_level.

In an embodiment of the present invention, piecewise linear segments are implemented digitally by a counter whose clock frequency is set for each segment according to the slope to be reproduced. Thresholds are identified so that fading up and down between two contiguous thresholds follows a linear trajectory. The time duration each segment is preferably chosen to be less than a predetermined time, so that steps in illumination intensity are imperceptible or barely perceptible by the human eye, having a frequency at about or greater than 25 Hz. In some embodiments, the duration of all piecewise linear segments are the same, whereas in other embodiments, the time duration of some segments may exceed the time duration of other segments. For example, in some embodiments, the time duration of piecewise linear segments at low light intensities are extended to provide a smoother transition and to better approximate the exponential characteristic.

Figure 5:
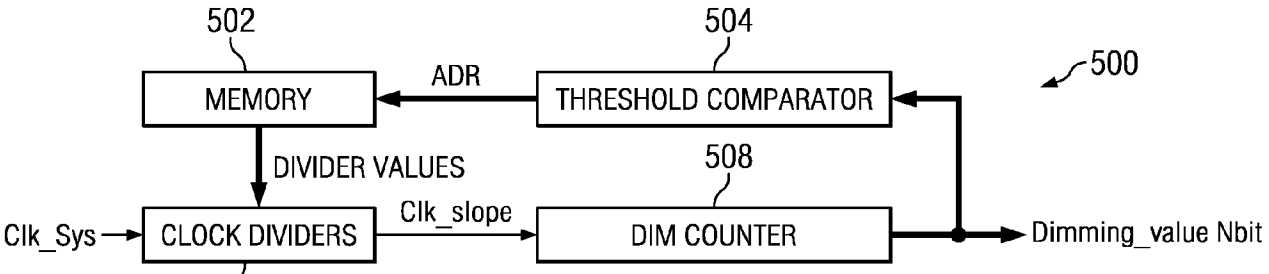
FIG. 5 illustrates an embodiment circuit that implements a piecewise linear control curve.

FIG. 5 illustrates circuit 500 that implements a piecewise linear control curve. Clock Dividers 506 adjust the frequency of system clock Clk_Sys to provide Clk_slope to provide the needed slope of the current piecewise linear segment. Dim Counter 508 increments based on Clk_slope to provide piecewise linear output Dimming_value. Threshold Comparator 504 compares Dimming_value to a plurality of thresholds to provide address Adr to memory 502. When a breakpoint between piecewise linear segments, for example points L__0, L__1, L__2, L__3 or L__4 shown in FIG. 4, is reached by Dim Counter 508, Threshold Comparator 504 provides the address of a next segment slope parameter to Memory 502. In some embodiments, memory 502 stores divider values addressable through the Threshold Comparator 504 output. In some embodiments, Threshold values are hard-coded, as also other constants needed by the circuit 500. In other embodiments, thresholds and divider values can be parameterized by using another block of memory, such as registers or RAM or EEPROM, for example. Memory 502 provides divider values to Clock Divider block 506 based on address signal Adr output from Threshold Comparator 504.

In embodiments of the present invention, circuit 500 is configured to provide a predetermined transition time $T_{tot}$ from an initial level to a final level. Preferably, the predetermined transition time is different for a positive dimming transition time $T_{tot}$(up) than for a negative dimming transition time $T_{tot}$(down). For example, in an embodiment, $T_{tot}$(up) is about 0.7 seconds and $T_{tot}$(down) is about 1.7 seconds. In alternative embodiments of the present invention, $T_{tot}$(up) and $T_{tot}$(down) can comprise other transition times. For 12 bits of dim resolution (0-4095) at Dimming_value, and for a tail (0-31) with a constant slope factor of 256, the maximum time for having dim steps occur at a frequency greater than 25 Hz is 2 seconds. In some embodiments, slower transition periods can also be used. Curve and level modifications are preferably greater than a dim step frequency of 25 Hz.

In order to achieve a predetermined transition time regardless of the number of segments, the frequency of Clk_slope is scaled to achieve a predetermined transition time, $T_{tot}$(up) or $T_{tot}$(down), regardless of the number of segments between initial and final values. For example, consider two cases with reference to the diagram of FIG. 4. In a first case, the desired start level is at L__0 and the desired stop level is at L__4. Therefore, the number of segments between the start and stop levels is 4. In a second case the desired start level is at L__1 and the desired stop level is at L__3, thereby making 2 segments between start and stop levels. In both cases, the time used to reach the stop level is the same (i.e. $T_{tot}$(up)). Considering only one segment of the curve, for instance, the segment between L__2 and L__3, called S2, Clock Dividers 506 generate two different frequencies for signal Clk_slope in the two cases, in order to produce a constant transition time $T_{tot}$(up). With respect to the two cases:

Freq_Clk_slope(Case 2, Sx)=¾ *Freq_Clk_slope(Case 1, Sx), where x=1, 2. Where Freq_Clk_slope is the frequency of Clk_slope.

Generally, the relationship between the frequency of Clk_slope, the number of piecewise linear segments is:

$$\text{Freq_slope_}N(Sx)=\text{Freq_slope_tot}(Sx)*N/D,\quad x=0,1,\ldots,D-1 \qquad \text{(Formula A)}$$

where,

N is the number of segments between the start level and the stop level;

D is the total number of segments of the dimming curve (in the example the number of segment between L__0 and L__4→D=4);

Freq_slope_tot(Sx) the frequency needed to set the slope of a single segment Sx of the curve when the start level is the lower(L__0) and the stop level is the higher(L__4); and Freq_slope_N(Sx) the frequency needed to set the slope of a single segment Sx of the curve when the number of segments between start level and stop level is N. Formula A indicates that Clock Dividers 506 provides an output signal whose frequency is linked to an input frequency by a ratio of N/D. In embodiments of the present invention, Clock Dividers 506 adapts the frequency of Clk_slope as a linear function of N and Freq_slope_tot(Sx). (i.e., Freq_Clk_slope(Sx)=Function (N, Freq_slope_tot(Sx)).)

Figure 6:
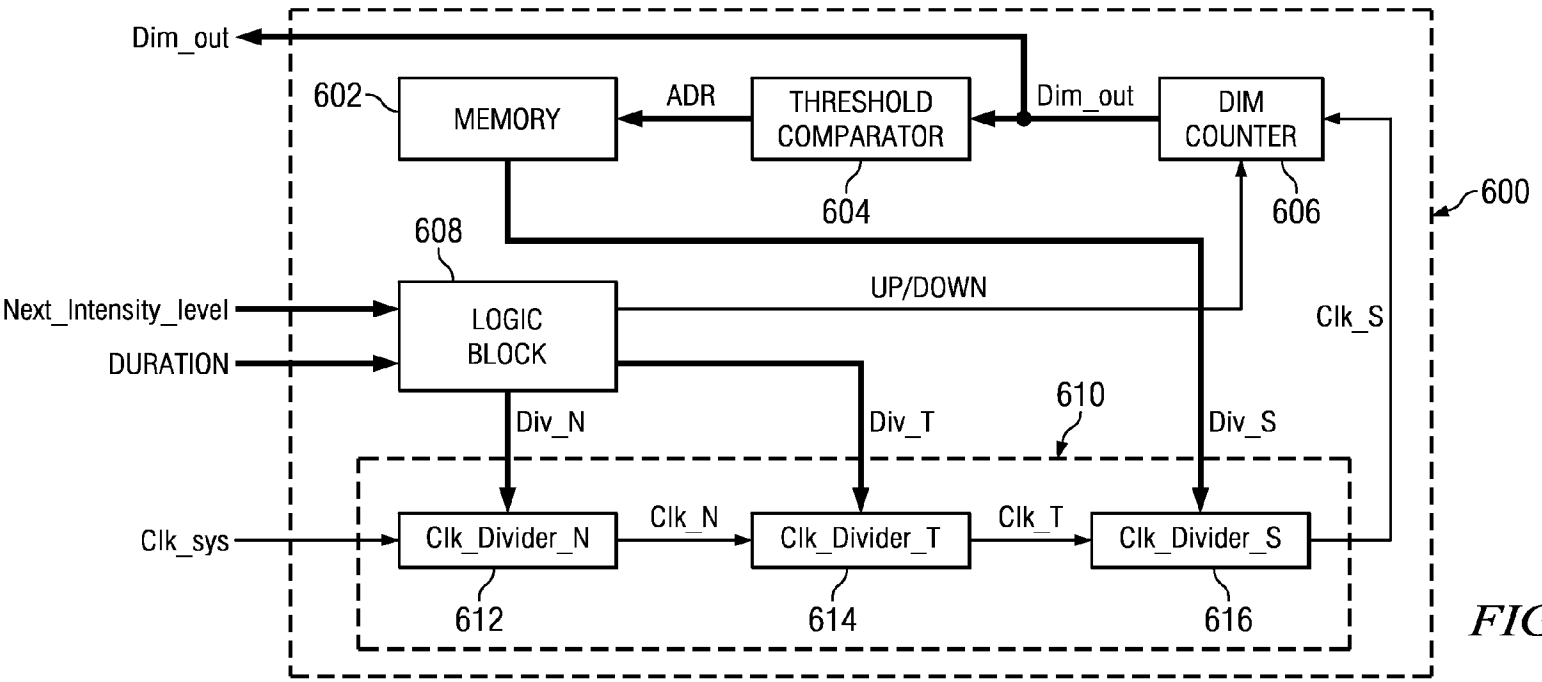
FIG. 6 illustrates an embodiment dimming engine.

FIG. 6 illustrates another embodiment of digital dimming engine 600. Digital dimming engine 600 has memory 602, threshold comparator 604, dim counter 606, logic block 608 and clock divider 610. Clock divider 610 has three patterned dividers 612, 614 and 616. Dim counter 606 increments or decrements depending on whether the new intensity level is greater or less than the previous intensity level. For example, to increase the light intensity level, dim counter will increment and to decrease the light intensity level, dim counter will decrement. Alternatively, dim counter 606 can be incremented to decrease the light intensity level if the light source, or its corresponding drivers and interface circuits operate according to a negative or inverted sense. Threshold comparator 604 updates, in real time, address Adr of the current parameters stored in memory 602. Memory 602 provides divider value Div_S (allocated at address Adr) to Clk_Divider_S 616. Div_S represents that number of periods of Clk_T to wait before dim counter increments or decrements Dim_out. Logic Block 608 provides divider value Div_T, which is a function of $T_{tot}$, to Clock_Divider_T 614. Logic Block 608 also provides Div_N, representing a number of segments to be traversed during a dimming operation, to Clock_Divider_N 612. Signal Up/down, which controls whether dim counter 606 increments or decrements, is supplied to dim_counter 606 by Logic Block 608.

With respect to clock divider 610, Clk_Divider_N 612 produces Clk_N as a function of the number of segments N, as described by Formula A hereinabove. Clk_Divider_T 614 produces Clk_T, the frequency of which is a function of a duration of the transition $T_{tot}$ and Clk_Divider_S 616 produces Clk_S as a function of a slope of a current piecewise linear segment. In some embodiments, Clk_Divider_N 612 can be replaced by a decimator that generates Clk_N to have an average frequency of $$F\text{Clk_}N=(N/D)*F\text{clk_}T \qquad \text{(Formula B)}$$

where,

FClk_N is the average frequency of Clk_N;

Fclk_T is the average frequency of Clk_T;

N is the number of segments between the start level and the stop level; and

D is the total number of segments of the dimming curve.

In an embodiment, the decimator removes (D-N) pulses in a group of D elements using, for example, pulse swallowing or other decimation techniques. Division ratios Div_N and Div_T are preferably set at the beginning of an intensity transition or dimming cycle and their values remain constant during the intensity transition or dimming cycle. On the other hand, Div_S changes when a threshold is reached in order that the output of Dim Counter 606 follows a piecewise linear curve. In alternative embodiments of the present invention, Div_N and Div_T can vary during an intensity transition or dimming cycle.

Figure 7:
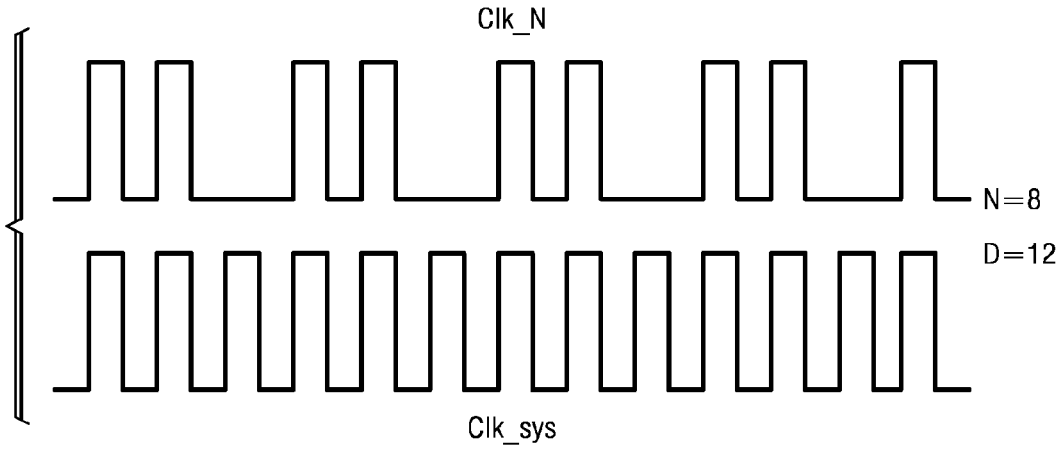
FIG. 7 illustrates an waveform diagram of an embodiment dimming engine.

FIG. 7 illustrates a waveform diagram showing the relationship between Clk_sys at the input to Clk_Divider_N and Clk_N at the output of Clk_Divider_N for N=8 and D=12. It can be seen that one out of every three pulses at Clk_sys is swallowed at Clk_N in order to achieve an 8:12 ratio between Clk_N and Clk_sys. It should be noted that N=8 and D=12 is used as an example, and that other ratios are possible depending on the particular application and its specifications.

Figure 8A:
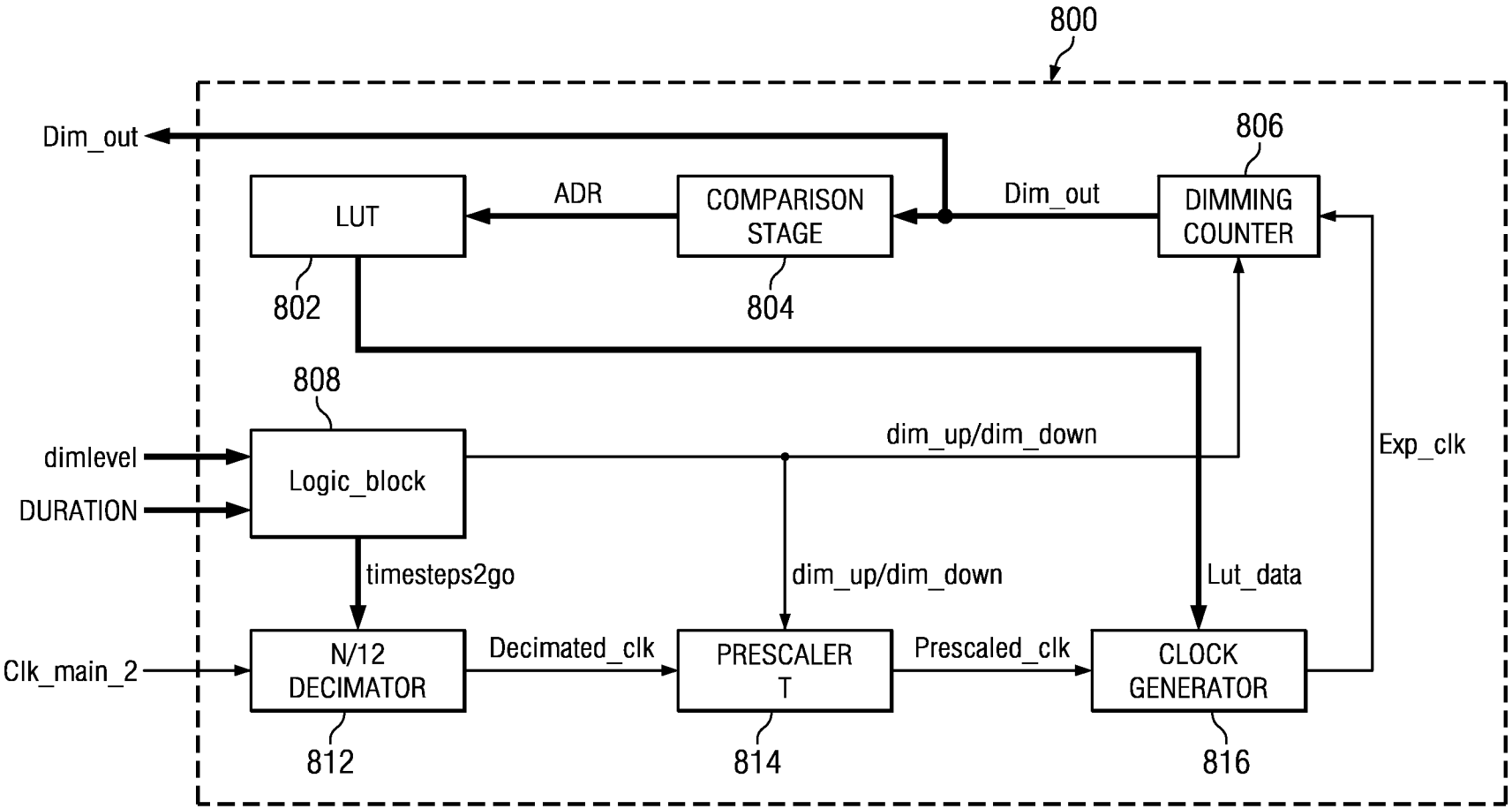
FIG. 8*a* illustrates another embodiment dimming engine.

FIG. 8*a* illustrates embodiment dimming engine 800, configured to implement 12 piecewise linear segments, in which Clk_Divider_N 612 of FIG. 6 is replaced with N/12 decimator 812, but functions in a similar manner as dimming engine 600 shown in FIG. 6. Digital dimming engine 800 further has look up table (LUT) 802, comparison stage 804, diming counter 806, logic block 808, prescaler T 814, and dimming counter clock generator 816. In comparison stage 804, comparison thresholds are placed at $2^n-1$ where n=0, 1, 2, 3, . . . , 12. Hence, it is possible to set one slope for each segment (i.e., n−1, or 11 slopes.) An embodiment relationship between linear segments, threshold levels, slope parameters and slope reciprocals is shown in FIG. 8*b* for a case of 11 slopes.

To eliminate all the visible steps of the dimming curve in an embodiment of the present invention, the lower tail of the exponential curve is accelerated. As shown in Table 1, the first five segments have the same slope, in order to create a single segment with double length 2*Tseg, where Tseg is the number of periods of Prescaled_clk that compose a basic segment. In some embodiments, acceleration of the tail may be insufficient to eliminate all the visible steps, so programmable levels are set only for levels 6-12. This is to ensure that dim levels are incremented at a rate of greater than about 24 Hz. If the dim levels are incremented at a lower rate, visible blinking of the LED could result. Therefore, when the transition is between the levels 0 and 6 the curve consists of 2 segments. The first segment has a slope of 255 and a length of 2*Tseg, while the second segment has a slope of 127 and a duration of Tseg, for a total time duration of 3*Tseg. In an embodiment, dimming engine 800 produces a curve having 8 segments with a same length of Tseg, except for the first segment that has a length of 3*Tseg.

TABLE 1

Comparison Thresholds and Lut_data.

| Level Number | Upper Level Limit | Lut_data |
|---|---|---|
| 0 | 0x000 | — |
| 1 | 0x001 | 255 |
| 2 | 0x003 | 255 |
| 3 | 0x007 | 255 |
| 4 | 0x00F | 255 |
| 5 | 0x01F | 255 |
| 6 | 0x03F | 127 |
| 7 | 0X07F | 63 |
| 8 | 0x0FF | 31 |
| 9 | 0x1FF | 15 |
| 10 | 0x3FF | 7 |
| 11 | 0x7FF | 3 |
| 12 | 0xFFF | 1 |

Logic_block 808 outputs parameter timesteps2go to N/12 decimator 812. Timesteps2go represents the number (N) of segments between the start and stop level. In an embodiment, N/12 decimator 812 removes (12−timesteps2go) pulses every 12 Clk_main__2 clock cycles with a few exceptions where the first segment is compensated, in which case, 3 is subtracted from timesteps2go. These subtractions preferably occur at the beginning of the dimming period. For example:

Start level=0,Stop level=6→"timesteps2go"=6−3=3;

Start level=12,Stop level=0→"timesteps2go"=12−3=9; and

Start level=6,Stop level=11→"timesteps2go"=(11−6)=5.

In an alternative embodiment of the present invention, the first few segments are not compensated or are compensated by different values. Inputs to Logic_block 808 includes dim-level, which represents a target illumination level, and Duration, which represents an up/down transition time.

In an embodiment, the dimming module system uses a clock source Clk_main__2 with a frequency of 256 kHz that is input to N/12 Decimator 812. The output of N/12 Decimator 812 is a clock whose frequency is function of the number of segments to be crossed during the intensity transition. In an embodiment, the device is set to provide two transition durations: a fade-up time of about 0.7 seconds and a fade-down time of about 1.7 seconds. In alternative embodiments, different valued for fade-up and fade-down time can be used, or the durations of the fade-up and fade-down times can be made to be programmable.

Prescaler_T 814 adjusts the frequency of decimated_clk, depending on whether dimming engine 800 is experiencing a fade-up transition or a fade-down transition. In the case of a fade-up transition, prescaler_T 814 divides the frequency of Decimated_clk by 4, and, in case of a fade-down transition, prescaler_T 814 divides the frequency of Decimated_clk by 9 to produce Prescaled_clk. In alternative embodiments of the present invention, other division ratios can be used for Prescaler_T 814.

Clock generator 816 divides Prescaled_clk by a factor of Lut_data+1. The +1 addendum to Lut Data is due to the particular implementation of the divider block because the embodiment divider counter counts from 0 to Lut_data. In alternative embodiments, other adjustments, or no adjustments may be necessary. Lut_data changes every time that a comparison threshold is reached by dim_out, and its value is inversely proportional to the slope of the segments. Lut_data value is listed as a function of the comparison threshold in Table 1 hereinabove. Exponential clock Exp_clk provided by Clock Generator 816 is provided to Dimming Counter that increments or decrements Dim_out by a unit at each edge of Exp_clk, to correspond to a fade up or down transition. Dim_out is the output of the Dimming Engine and could be used as an input to pulse modulator 110 shown in FIG. 1.

Figure 9:
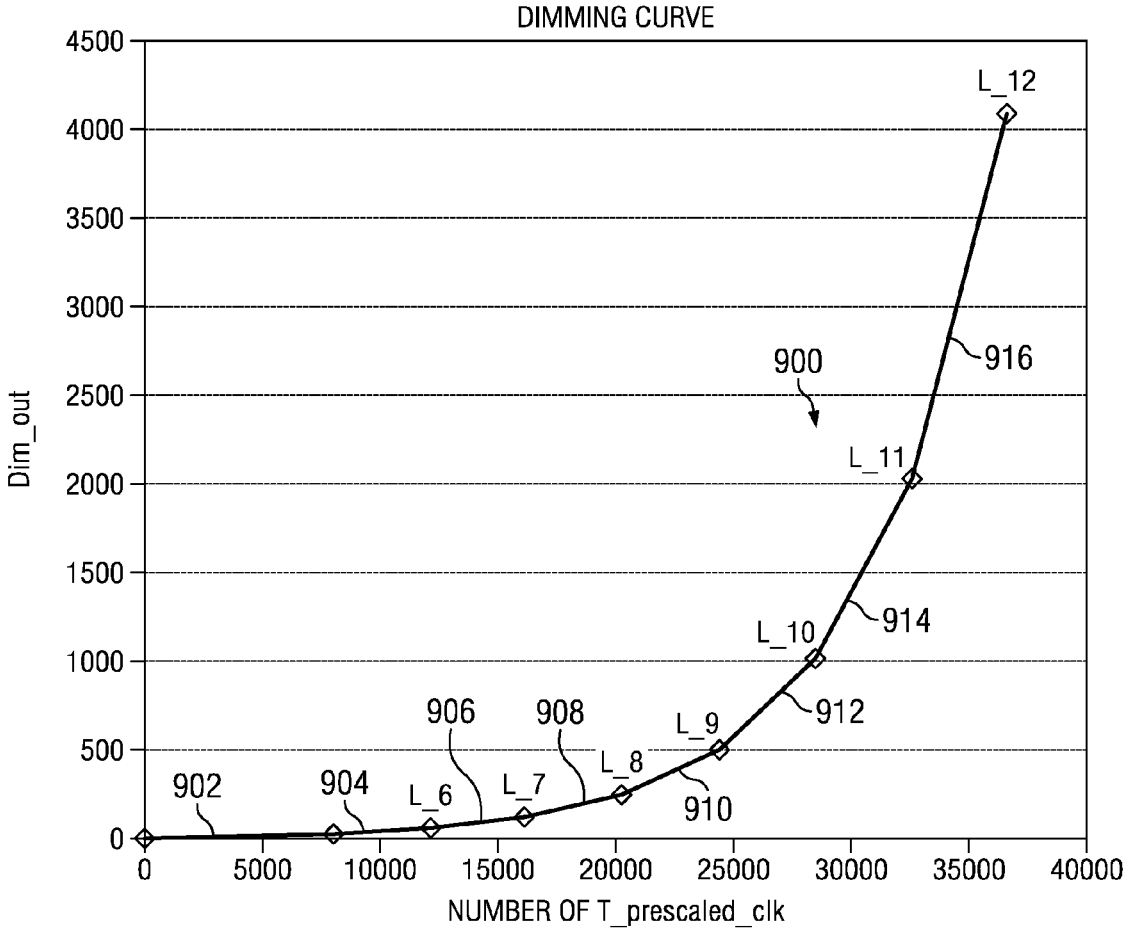
FIG. 9 illustrates an embodiment dimming characteristic.

FIG. 9 illustrates dimming curve 900 produced by dimming engine 800 of FIG. 8. Curve 900 represents the value of Dim_out versus a number of elapsed cycles of Prescaled_clk. Curve 900 has 8 segments 902, 904, 906, 908, 910, 912, 914 and 916.

Figure 10:
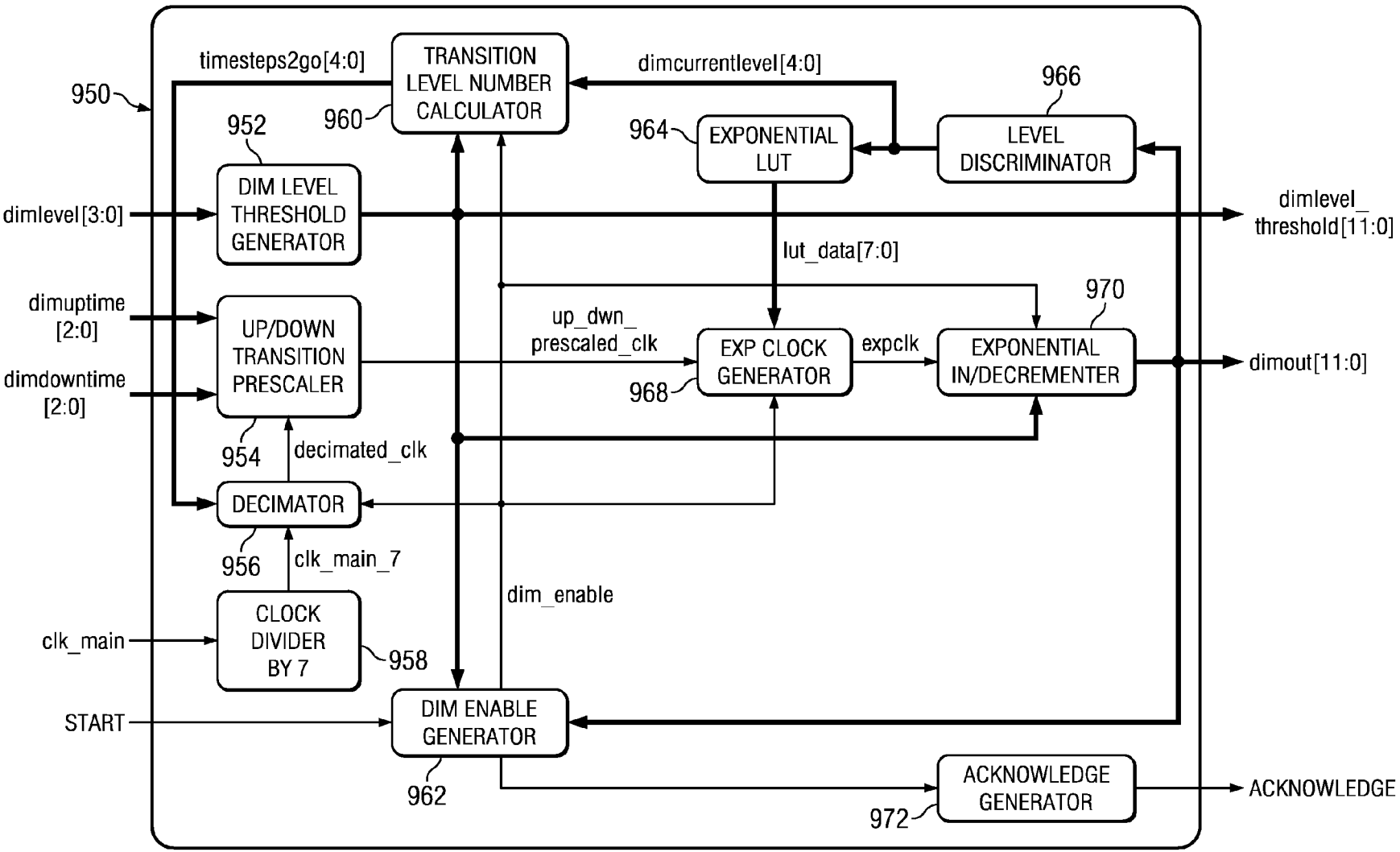
FIG. 10 illustrates a further embodiment dimming engine.

FIG. 10 illustrates further embodiment dimming engine 950. In the embodiment of FIG. 10, clock divider block 958 divides clk_main by a factor of 7 to produce Clk_main__7. In the embodiment, clk_main is about 1800 kHz and clk_main__7 is about 512 kHz. Clk_main__7 goes to decimator 956 to generate decimated_clk, whose task is to stretch part of the linear piece wise pseudo exponential curve to an up/down time that is constant for all transitions from level to level. In the current embodiment, the default transition times are 0.7 seconds for dimming up and 1.7 seconds for dimming down. Up/down transition prescaler 954 scales decimated_clk to reach the dimming times for up or down transitions, according with the parameters dimuptime[2:0] and dimdowntime[2:0]. In an embodiment of the present invention, dimuptime[2:0] and dimdowntime[2:0] are coded as shown in Table 2.

TABLE 2

Transition time coding

| Code | Transition Time (sec) |
|---|---|
| 000 | 0.28 |
| 001 | 0.43 |
| 010 | 0.58 |
| 011 | 0.71 |
| 100 | 1.00 |
| 101 | 1.28 |
| 110 | 1.71 |
| 111 | 2.00 |

In alternative embodiments of the present invention, other transition values can be associated with the codes. These values are hard coded in some embodiments, and programmable in other embodiments. For example, programmable values can be stored in the same memory as the counter thresholds. Decimation action is performed prior to transition prescaling in order to minimize time resolution error, since the clock period is lower at this point.

Up_dwn_prescaled_clk is used by exp clock generator 968, which generates expclk according to the lut_data input. The frequency of expclk modulates the counting slope of the exponential in/decrementer 970 to follow a trajectory of a piecewise linear approximation of an exponential curve. Dimout is used by level discriminator 966 to provide a current level sector of the curve so that dimcurrentlevel[4:0] becomes the address of exponential LUT 964 (lookup table), whose output is lut_data.

Dim level threshold generator 952 determines a desired output threshold to be reached by the dimming module. When the dimming function is not being used, the desired output threshold represents an output set point. Dimlevel_threshold is used by exponential in/decrementer 970 and also by the transition level number calculator 960, whose output timesteps2go is used by decimator 956. For example, if dimlevel_threshold is greater than dimout, in/decrementer 970 is incremented. If, on the other hand, dimlevel_threshold not is less than dimout, in/decrementer 970 is decremented. If the current value of in/decrementer 970 is held. Transition level number calculator 960 calculates the number of transition levels to cross at the beginning of a transition, based to the current dim level (dimout) and the desired level (dimlevel also coded as dimlevel_threshold).

Dim enable generator 962 enables all the other dimming engine components when the current dim output value dimout [11:0] and the desired dim value (dimlevel threshold[11:0]) do not match. Acknowledge generator 972 asserts signal acknowledge at the end of a dimming transition.

Table 3 illustrates slopes of the linear sections of the piecewise linear approximated exponential curve of the embodiment dimming engine 950 shown in FIG. 10. The dim factor upper limit is bound to the dimout bit resolution, i.e. 12 bits, so that 13 binary levels can be defined. For example, the slope value of 2 is adopted between the dim values 2048 and 4095. In order to achieve an effective approximation of a pure exponential curve, a slope of 512 is placed at binary level 4, and a slope of 1024 is placed at binary level 3. The tail of the exponential curve is given a slope of 256 to keep the curve under the visible threshold.

TABLE 3

Slopes of resultant piecewise linear exponential curve.

| Dim Factor | Binary Level | Slope |
|---|---|---|
| 4095 | 12 | 2 |
| 2048 | 11 | 4 |
| 1024 | 10 | 8 |
| 512 | 9 | 16 |
| 256 | 8 | 32 |
| 128 | 7 | 64 |
| 64 | 6 | 128 |
| 32 | 5 | 256 |
| 16 | 4 | 256 |
| 8 | 3 | 256 |
| 4 | 2 | 256 |
| 2 | 1 | 256 |
| 1 | 0 | 256 |

It should be noted that alternative embodiment dimming engines can possess an arbitrary number of dimming levels depending on the particular application and its specifications.

Figure 11A:
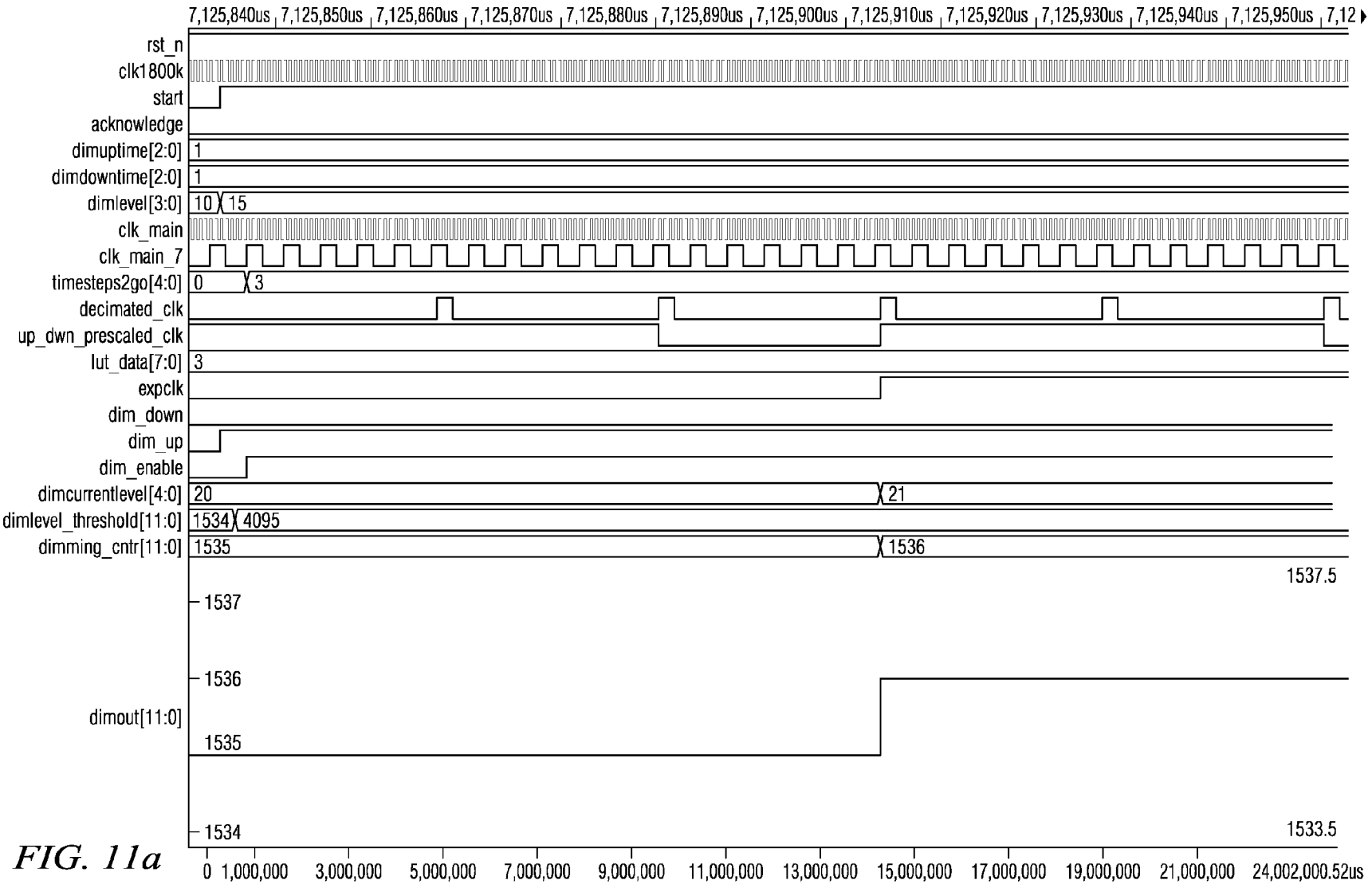
FIGS. 11*a-c* illustrate timing diagrams and dimming curves of the further embodiment dimming engine.
Figure 11B:
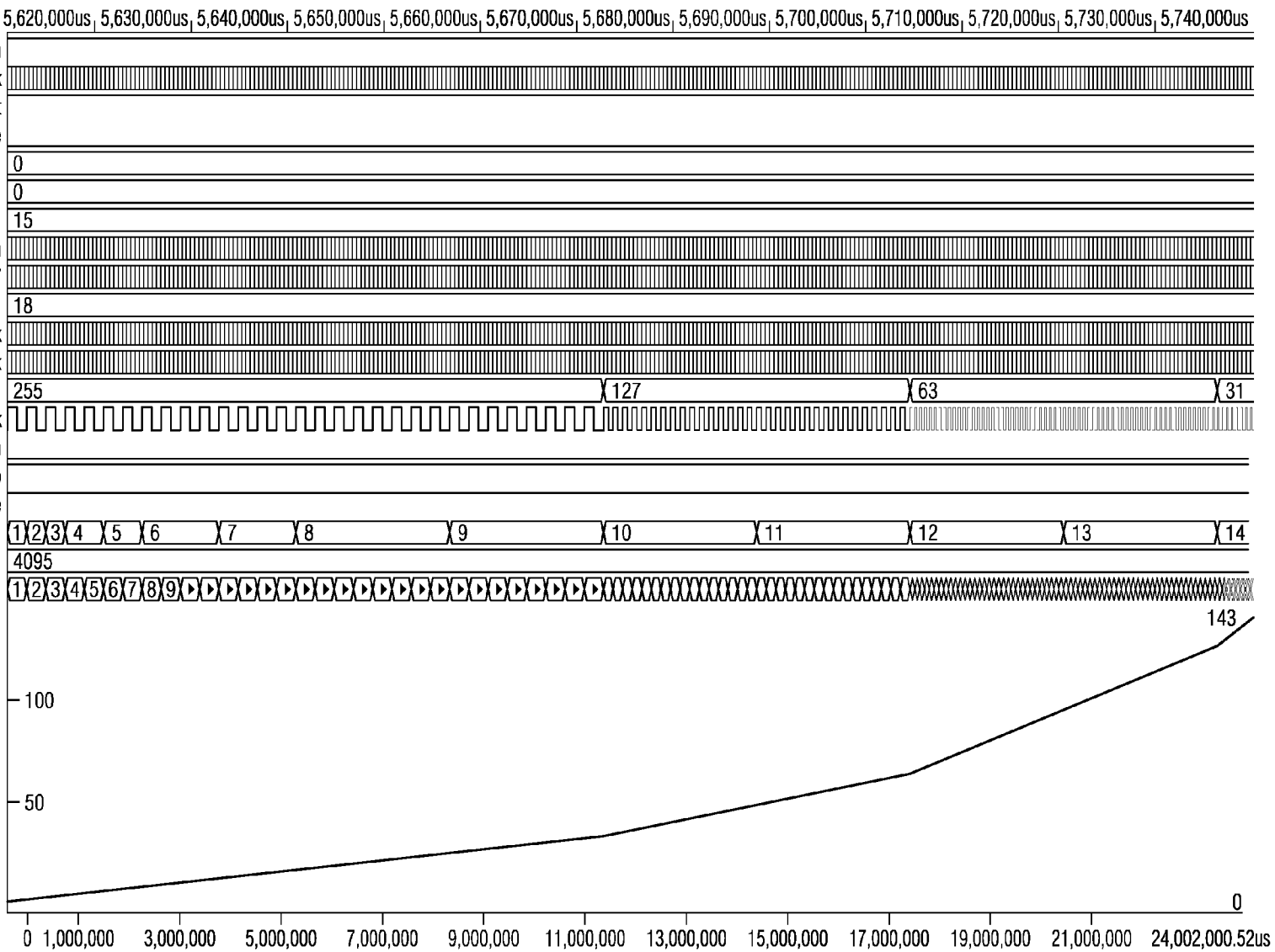
Figure 11C:
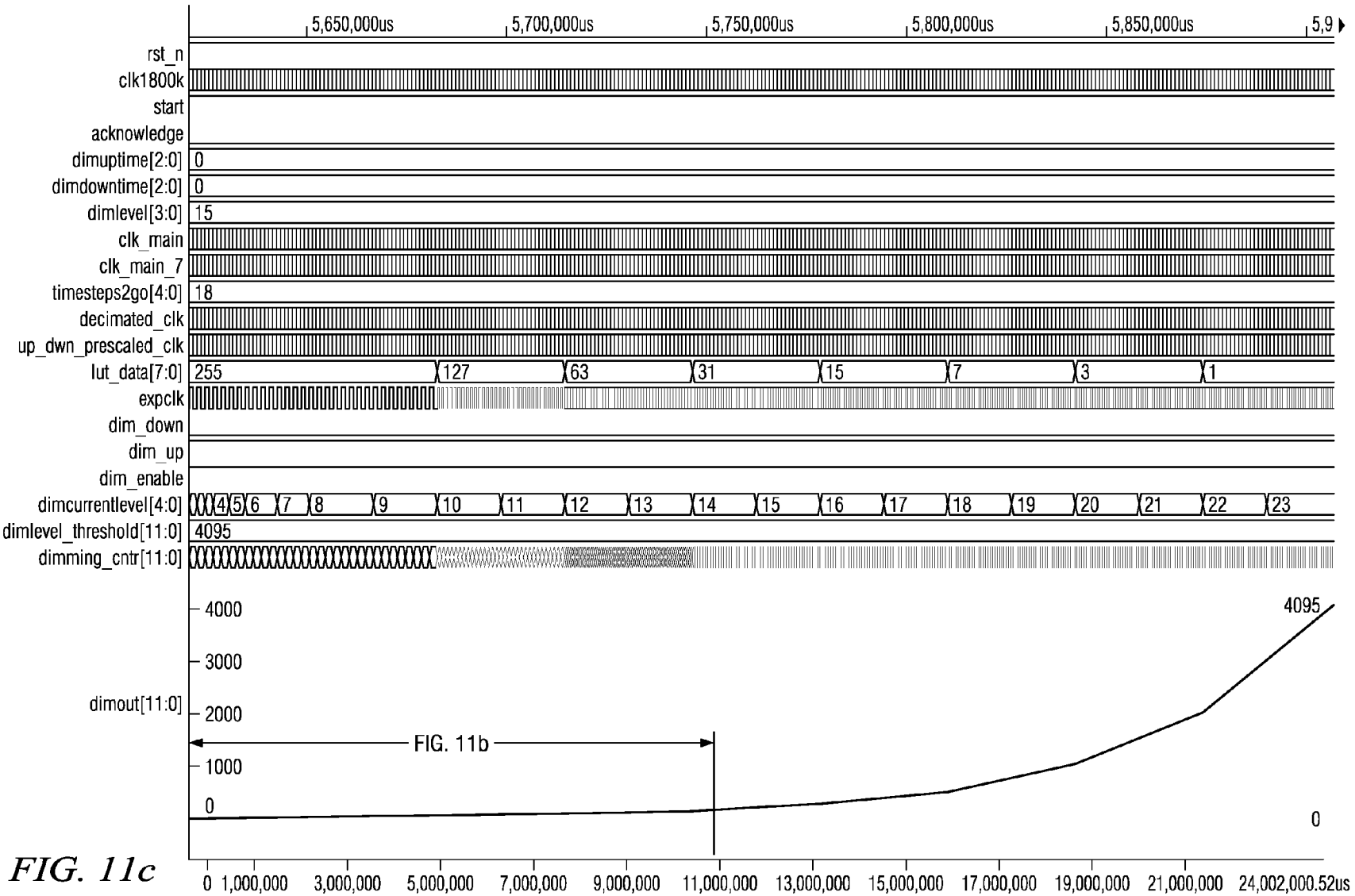
Figure 12:
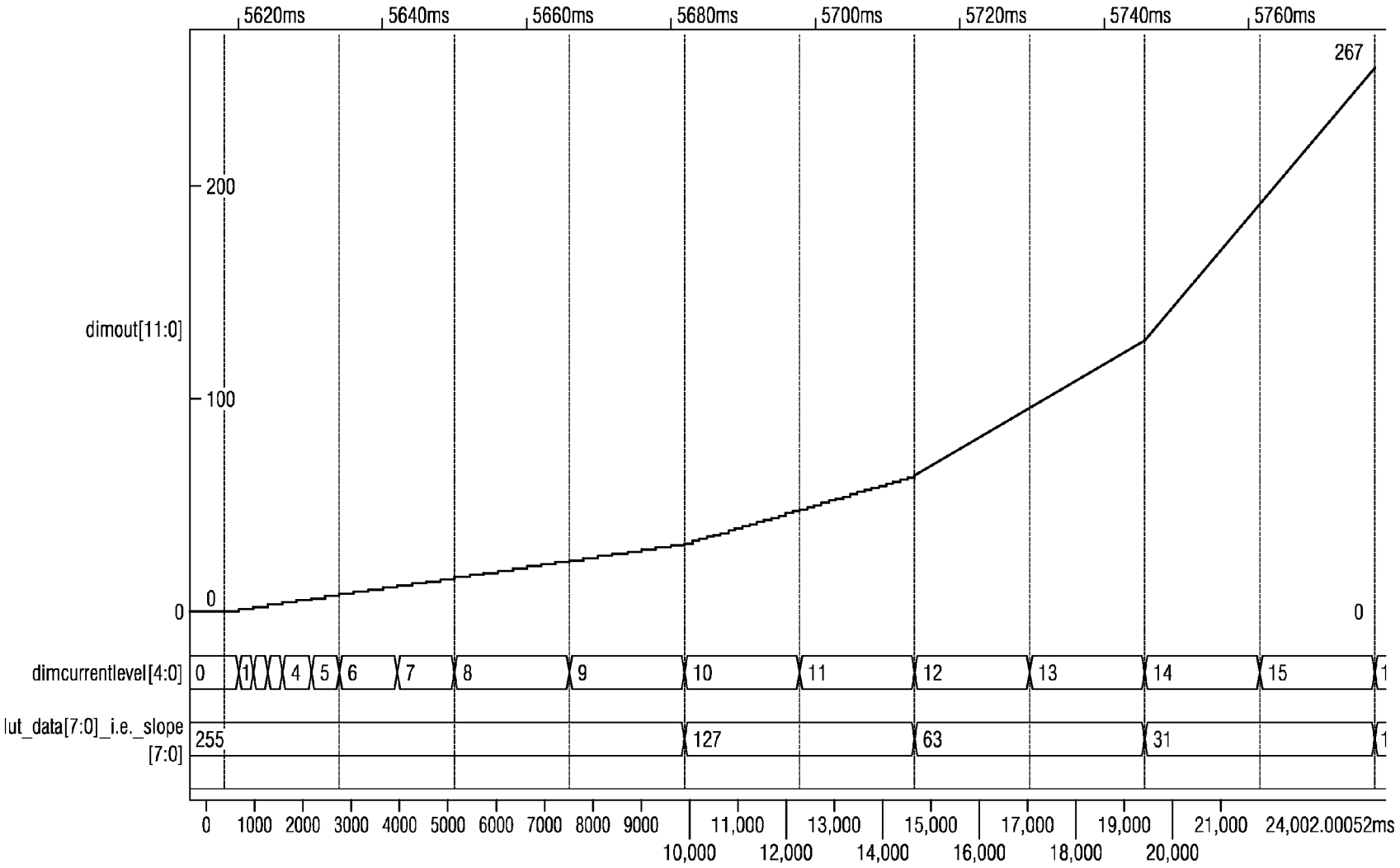
FIGS. 12 and 13 illustrate portions of the dimming curves of FIGS. 11*a-c*.
Figure 13:
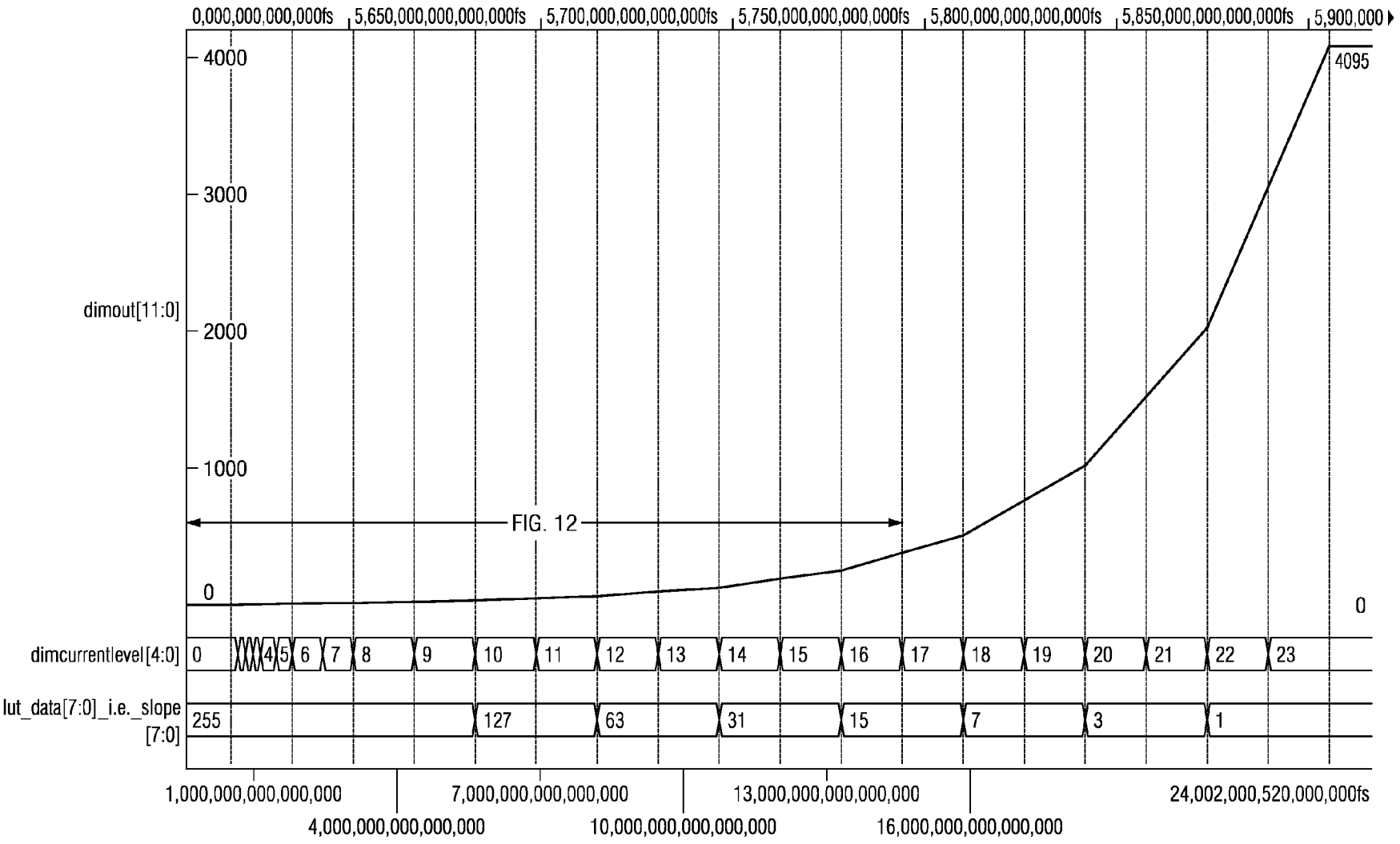

FIGS. 11*a-c* illustrates a waveform diagrams illustrating the operation of the embodiment dimming engine 950 of FIG. 10. FIG. 11*a* is a detailed view of the waveform diagram, FIGS. 11*b-c* illustrate progressively zoomed out views. (The portion of FIG. 11*c* that incorporates FIG. 11*b* is noted in FIG. 11*c*.) FIGS. 12 and 13 illustrate the same dimming curve shown in FIGS. 11*a-c*, enhanced in height in order to emphasize the relationship between the curve, the dim current levels and the slope factors. FIG. 12 illustrates a zoomed in portion of FIG. 13.

Figure 14:
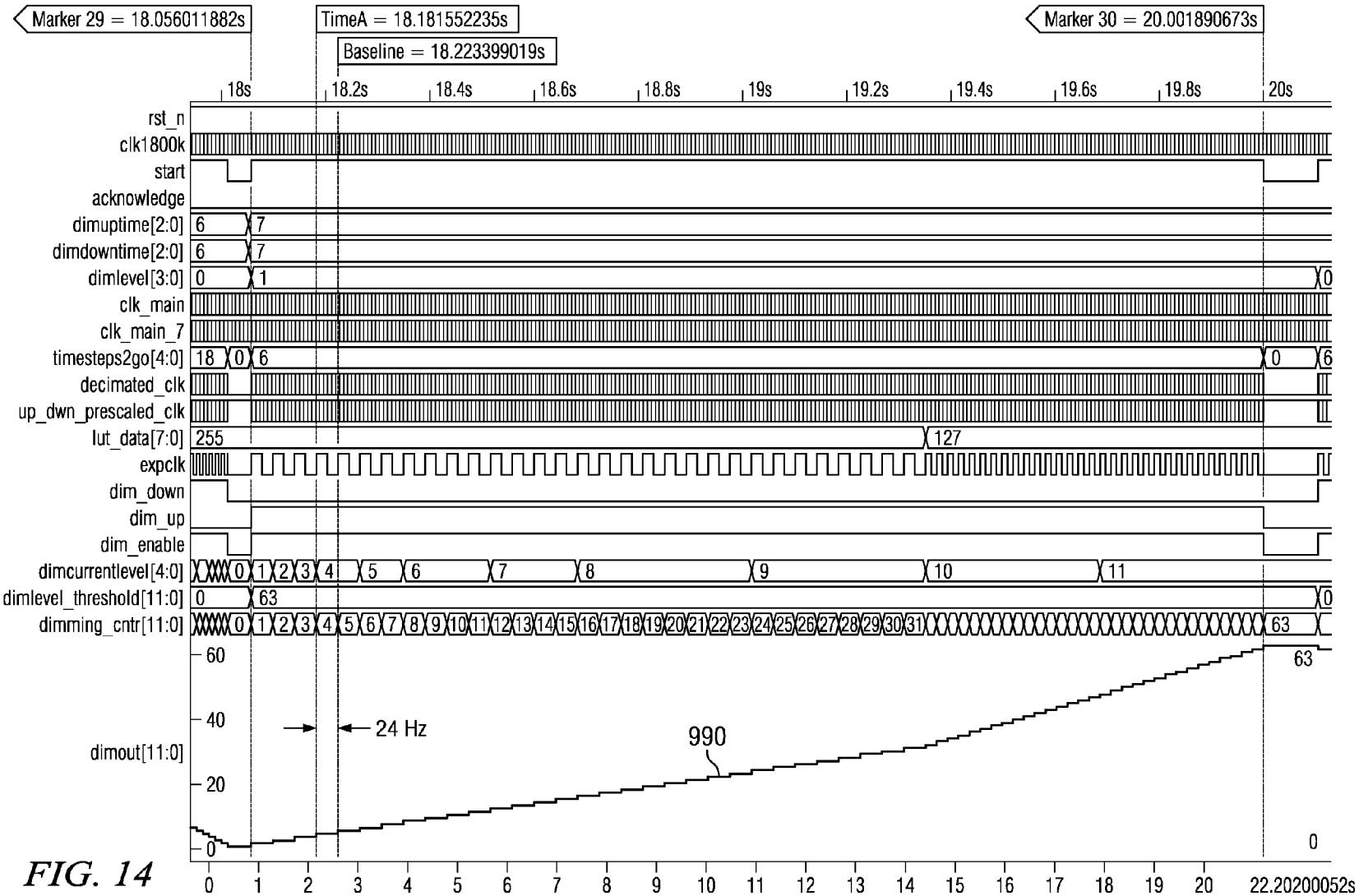
FIG. 14 illustrates a timing diagram and dimming curve at low levels of intensity.

FIG. 14 illustrates a timing diagram and a resulting dimming curve 990 for low levels of intensity. In particular, the first level at 1.5% of maximum intensity is reached with a dim value of 63. The frequency of the dim step shown in FIG. 14 is about 24 Hz. The total transition time from level 0 to level 11 is about 2 seconds.

One advantage of embodiments of the present invention includes structural simplicity in that embodiment systems include basic digital blocks. Another advantage is that, in embodiments, smooth fading down to no-light and smooth fading up from no-light is achievable without the need of a high frequency clock and/or complicated arithmetic.

It will also be readily understood by those skilled in the art that materials and methods may be varied while remaining within the scope of the present invention. It is also appreciated that the present invention provides many applicable inventive concepts other than the specific contexts used to illustrate embodiments. Accordingly, the appended claims are intended to include within their scope such processes, machines, manufacture, compositions of matter, means, methods, or steps.

What is claimed is:

1. A light dimming module comprising:

a digital input interface;

a dimming engine coupled to the digital input interface, the dimming engine configured to provide a digital control signal having N-segment piecewise linear approximation of an exponential ramp from a starting intensity level to a final intensity level over a predetermined transition time, wherein the digital control signal represents values in a linear scale, wherein the dimming engine comprises:

an exponential clock generator, a dimming counter coupled to an output of the exponential clock generator, and a prescaler coupled to an input of the exponential clock generator; and an output interface coupled to the dimming engine, the output interface configured to control the intensity of a light source.

2. The light dimming module of claim 1, wherein the output interface comprises a pulse generator configured to produce a pulse signal having a pulse density proportional to a level of the digital control signal.

3. The light dimming module of claim 2, wherein the pulse generator comprises a sigma-delta modulator comprising an output coupled to a current source, the current source configured to drive a light emitting diode.

4. The light dimming module of claim 2, wherein the pulse generator comprises a plurality of pulse generators comprising an input coupled to the digital control signal, each of the plurality of pulse generators configured to be coupled to a light source of a different color, wherein each of the plurality of pulse generators scales the digital control signal by an independent intensity signal in order to produce a composite color.

5. The light dimming module of claim 1, wherein:

the digital input interface comprises a LIN bus; and the dimming module is configured to control a light source in an automobile, wherein the digital input interface is configured to accept a command word comprising an illumination level.

6. A circuit for producing a digital control signal, the circuit comprising a calculation block configured to provide the digital control signal having an N-segment piecewise linear approximation of an exponential ramp from a starting level to a final level over a transition time, wherein the digital control signal represents the exponential ramp in N linearly scaled segments;

an increment counter comprising a dimming signal output; and an exponential clock generator comprising an output coupled to an input of the increment counter, the exponential clock generator configured to change a frequency of the output according to a piecewise linear segment.

7. The circuit of claim 6, further comprising a digital input interface configured to provide the final level.

8. The circuit of claim 7, wherein the digital input interface is further configured to provide the transition time and the starting level.

9. The circuit of claim 6, wherein:

the starting level represents a starting light intensity level;

the final level represents a final light intensity level; and the transition time represents a time to transition between light intensity levels.

10. The circuit of claim 6, further comprising a pulse modulator comprising an input coupled to the digital control signal.

11. The circuit of claim 10, further comprising a light source coupled to an output of the pulse modulator.

12. The circuit of claim 6, wherein each of the N linearly scaled segments comprise a same duration.

13. The circuit of claim 6, wherein a first portion of the N linearly scaled segments comprises a longer duration than a last portion of the N linearly scaled segments.

14. A method for producing a piecewise linear exponential control signal, the method comprising:

providing a control signal having a first linearly scaled digital value; and using a dimming counter, incrementing the control signal according to an N-segment piecewise linear approximation of an exponential ramp from the first linearly scaled digital value to a final linearly scaled value over a transition time, wherein the dimming engine comprises:

an exponential clock generator, a dimming counter coupled to an output of the exponential clock generator, and a prescaler coupled to an input of the exponential clock generator.

15. The method of claim 14, further comprising receiving the final linearly scaled value from a digital interface.

16. The method of claim 14, further comprising coupling the piecewise linear exponential control signal to a pulse modulator.

17. The method of claim 16, further comprising coupling an output of the pulse modulator to a light source, wherein the piecewise linear exponential control signal controls an illumination intensity of the light source.

18. The method of claim 14, wherein each of N-segments comprise a same time duration.

19. A light dimming module comprising:

a digital input interface;

a dimming engine coupled to the digital input interface, the dimming engine configured to provide a digital control signal having N-segment piecewise linear approximation of an exponential ramp from a starting intensity level to a final intensity level over a predetermined transition time, wherein the digital control signal represents values in a linear scale; and an output interface coupled to the dimming engine, the output interface configured to control the intensity of a light source, wherein the output interface comprises a pulse generator configured to produce a pulse signal having a pulse density proportional to a level of the digital control signal, wherein the pulse generator comprises a plurality of pulse generators comprising an input coupled to the digital control signal, each of the plurality of pulse generators configured to be coupled to a light source of a different color, wherein each of the plurality of pulse generators scales the digital control signal by an independent intensity signal in order to produce a composite color.

20. A light dimming module comprising:

a digital input interface configured to be coupled to an output of a microcontroller;

a dimming engine comprising an exponential clock generator coupled to the digital input interface, the dimming engine configured to provide a digital control signal having N-segment piecewise linear approximation of an exponential ramp from a starting intensity level to a final intensity level over a predetermined transition time, wherein the digital control signal represents values in a linear scale; and an output interface coupled to the dimming engine, the output interface configured to control the intensity of a light source, wherein the output interface comprises a pulse generator configured to produce a pulse signal having a pulse density proportional to a level of the digital control signal.

21. The light dimming module of claim 20, wherein the pulse generator comprises a plurality of pulse generators comprising an input coupled to the digital control signal, each of the plurality of pulse generators configured to be coupled to a light source of a different color.

22. The light dimming module of claim 21, wherein each of the plurality of pulse generators scales the digital control signal by an independent intensity signal in order to produce a composite color.

23. The light dimming module of claim 20, wherein the dimming engine comprises:

a dimming counter coupled to an output of the exponential clock generator; and a prescaler coupled to an input of the exponential clock generator.

24. The light dimming module of claim 20, wherein the digital input interface is configured to implement a serial communications protocol and is configured to receive a digital control word comprising the starting intensity level, the final intensity level, and the predetermined transition time.

* * * * *